US010684028B2

(12) United States Patent
Liu et al.

(10) Patent No.: US 10,684,028 B2
(45) Date of Patent: Jun. 16, 2020

(54) PIPE SHIELD OF VENTILATING APPARATUS

(71) Applicants: PANASONIC ECOLOGY SYSTEMS GUANGDONG CO., LTD., Guangdong (CN); PANASONIC CORPORATION, Osaka (JP)

(72) Inventors: Donghai Liu, Guangdong (CN); Jianqiang Wu, Guangdong (CN); Jiahan Hong, Guangdong (CN); Naoyuki Funada, Aichi (JP); Masato Suzuki, Aichi (JP)

(73) Assignees: Panasonic Ecology Systems Guangdong Co., Ltd., Foshan, Guangdong (CN); Panasonic Corporation, Osaka (JP)

( * ) Notice: Subject to any disclaimer, the term of this patent is extended or adjusted under 35 U.S.C. 154(b) by 254 days.

(21) Appl. No.: 15/748,725

(22) PCT Filed: Jul. 21, 2016

(86) PCT No.: PCT/CN2016/090841
§ 371 (c)(1),
(2) Date: Jan. 30, 2018

(87) PCT Pub. No.: WO2017/020727
PCT Pub. Date: Feb. 9, 2017

(65) Prior Publication Data

US 2019/0011141 A1 Jan. 10, 2019

(30) Foreign Application Priority Data

Jul. 31, 2015 (CN) ..... 2015 2 0576663 U

(51) Int. Cl.
*F24F 7/007* (2006.01)
*F24F 13/24* (2006.01)
(Continued)

(52) U.S. Cl.
CPC ..... *F24F 7/007* (2013.01); *F24F 13/082* (2013.01); *F24F 13/24* (2013.01); *F24F 11/0001* (2013.01); *F24F 13/075* (2013.01)

(58) Field of Classification Search
CPC ..... F24F 13/082; F24F 13/20; F24F 2221/52; F24F 13/24; F24F 13/10; F24F 13/14; F24F 13/1426; F24F 13/08
(Continued)

(56) References Cited

U.S. PATENT DOCUMENTS 2,800,853 A * 7/1957 Spear ..... F24F 7/007 454/350
5,236,391 A * 8/1993 Schaefer ..... A01K 1/0064 454/253
(Continued)

FOREIGN PATENT DOCUMENTS

CN 101625143 A 1/2010
CN 102287402 A 12/2011
(Continued)

OTHER PUBLICATIONS

International Search Report issued in PCT/CN2016/090841 dated Oct. 17, 2016, 4 pages.

*Primary Examiner* — Vivek K Shirsat
*Assistant Examiner* — Ko-Wei Lin
(74) *Attorney, Agent, or Firm* — RatnerPrestia

(57) ABSTRACT

A pipe shield of a ventilating apparatus is disposed at an outdoor side relative to a ventilating apparatus body disposed at an indoor side, and includes a pipe shield base and a rear cover. The pipe shield has an air inlet and an air outlet disposed perpendicular to each other. The pipe shield's rear cover has a left side plate, a right side plate and a rear side plate. The distance from the pipe shield base to the rear side plate of the rear cover opposite to the air inlet of the pipe shield increases in a direction towards the air outlet of the
(Continued)

pipe shield. A baffle is disposed at the middle portion of the rear cover, and fixed within the pipe shield by a rotating shaft fixed on the left side plate and the right side plate, the rotating shaft has a spring enabling the baffle to unfold.

6 Claims, 5 Drawing Sheets

(51) Int. Cl.
*F24F 13/08* (2006.01)
*F24F 13/075* (2006.01)
*F24F 11/00* (2018.01)

(58) Field of Classification Search
USPC ..... 454/350–351, 353, 367–368, 339, 347, 454/358, 359
See application file for complete search history.

(56) References Cited

U.S. PATENT DOCUMENTS

| | | | | |
|---|---|---|---|---|
| 5,924,922 | A | 7/1999 | Eakin et al. | |
| 2010/0000711 | A1 | 1/2010 | Tian et al. | |
| 2014/0261822 | A1* | 9/2014 | Haupt ..... | F16K 47/045 137/803 |

FOREIGN PATENT DOCUMENTS

| | | | |
|---|---|---|---|
| CN | 103348191 | A | 10/2013 |
| CN | 104454633 | A | 3/2015 |
| JP | 2012112634 | A | 6/2012 |
| WO | 2012079167 | A1 | 6/2012 |

* cited by examiner

PIPE SHIELD OF VENTILATING APPARATUS

CROSS REFERENCE TO RELATED APPLICATIONS

This application is the U.S. National Phase application of PCT/CN2016/090841, filed Jul. 21, 2016, which claims priority to Chinese Patent Application No. 201520576663.8, filed Jul. 31, 2015, the contents of such applications being incorporated by reference herein.

BACKGROUND OF THE INVENTION

Field of the Invention

The present disclosure relates to a pipe shield, more particularly to a pipe shield of a ventilating apparatus.

Description of the Related Art

FIG. 1 is a schematic view of a pipe shield of a ventilating apparatus in the prior art.

As shown in FIG. 1, the ventilating apparatus 1 in the prior art includes: a ventilating apparatus body disposed at an indoor side and having a ventilating apparatus frame 2 and a barrel; a pipe shield 3 disposed at an outdoor side and having a pipe shield base 4 and a rear cover 5; a baffle 7 capable of pivoting within the rear cover 5 around a rotating shaft 6 disposed at an upper portion of the rear cover 5 of the pipe shield 3; and a spring 8 capable of controlling closing of the baffle 7. Furthermore, the pipe shield 3 is provided with an air inlet 11 and an air outlet 12. The baffle 7 is a flat plate which is arranged in parallel with the air inlet 11 of the pipe shield 3. The ventilating apparatus frame 2 is provided with a panel 13 which is freely attachable to the ventilating apparatus body. In addition, the barrel is provided with a ventilating apparatus motor therein, and the baffle 7 is rotated so as to be opened or closed by an air pressure and an elastic force of the spring 8.

Moreover, since the ventilating apparatus motor is installed in the barrel, the pipe shield 3 is usually disposed at the outdoor side of the barrel in order to prevent wind and rain from flowing into the ventilating apparatus motor inside the barrel and into the room. Moreover, in order to prevent the wind and rain from reversely flowing into the room when the ventilating apparatus 1 is stopped, the baffle 7 is usually provided in the pipe shield 3.

Moreover, when the ventilating apparatus 1 is in operation, the baffle 7 is opened by the air pressure so as to achieve a ventilating function. However, when the ventilating apparatus 1 is stopped, the baffle 7 is closed by the elastic force of the spring 8 so as to block the air inlet 11 of the pipe shield 3 and prevent the wind and rain from flowing into the air inlet 11 of the pipe shield 3 and reversely flowing into the room. Moreover, it can prevent the foreign matters and worm and the like from entering into the room through the air inlet 11 of the pipe shield 3.

In the ventilating apparatus 1 in the prior art, the baffle 7 is a flat plate capable of pivoting within the rear cover 5 around the rotating shaft 6 disposed at the upper portion of the rear cover 5 of the pipe shield 3 and blocks the air inlet 11 of the pipe shield 3, and has an area at least substantially the same as that of the air inlet 11 of the pipe shield 3. When the baffle 7 is opened by the air pressure during the operation of the ventilating apparatus 1, since the baffle 7 is large in area and is capable of pivoting within the rear cover 5 around the rotating shaft 6 disposed at the upper portion of the rear cover 5 of the pipe shield 3, as the air blown by the ventilating apparatus 1 is blown toward the baffle 7, in addition to the elastic force of the spring 8 for closing the baffle 7, the air pressure also needs to overcome the weight of baffle 7 itself so as to open the baffle 7. Therefore, there will be a greater air resistance and thus the air flow is adversely affected.

Further, since the baffle 7 is a flat plate capable of pivoting within the rear cover 5 around the rotating shaft 6 disposed at the upper portion of the rear cover 5 of the pipe shield 3, when the ventilating apparatus 1 is stopped, the baffle 7 is closed by the spring force of the spring 8. Since the baffle 7 is capable of pivoting within the rear cover 5 around the rotating shaft 6 disposed at the upper portion of the rear cover 5 of the pipe shield 3 and has a relatively large area and is closed only by the spring force of the spring 8, the baffle 7 may be not completely closed in the case that there is a strong typhoon outside, resulting in a wind reverse-flowing into the room.

SUMMARY OF THE INVENTION

An object of the present disclosure is to provide a pipe shield of a ventilating apparatus, which may both increase blast volume and effectively prevent a reverse-flow into the ventilating apparatus.

In order to achieve the above-mentioned object, the present disclosure provides a pipe shield of a ventilating apparatus disposed at an outdoor side relative to a ventilating apparatus body disposed at an indoor side, and comprising a pipe shield base and a rear cover, wherein the pipe shield is provided with an air inlet and an air outlet disposed perpendicular to each other, and the rear cover of the pipe shield is provided with a left side plate, a right side plate and a rear side plate, and the distance from the pipe shield base to the rear side plate of the rear cover opposite to the air inlet of the pipe shield increases in a direction towards the air outlet of the pipe shield; a baffle is disposed at the middle portion of the rear cover, and fixed within the pipe shield by a rotating shaft fixed on the left side plate and the right side plate, the rotating shaft being provided with a spring capable of enabling the baffle to unfold; when the ventilating apparatus body is stopped, the baffle is adapted to close an air flow path by means of an elastic force of the spring; and when the ventilating apparatus body is in operation and the baffle is adapted to open the air flow path, the baffle is disposed at an intersecting surface within the pipe shield and between an airflow a flow direction of which has been changed by the rear cover of the pipe shield and an airflow a flow direction of which has not been changed, and is disposed in the same direction as a flow direction of the airflow blown out from the air outlet of the pipe shield.

The present disclosure has the advantages of preventing wind and rain from reversely flowing into the room while reducing air resistance and increasing blast volume and reducing noise.

DETAILED DESCRIPTION OF PREFERRED EMBODIMENTS OF THE INVENTION

Figure 1:
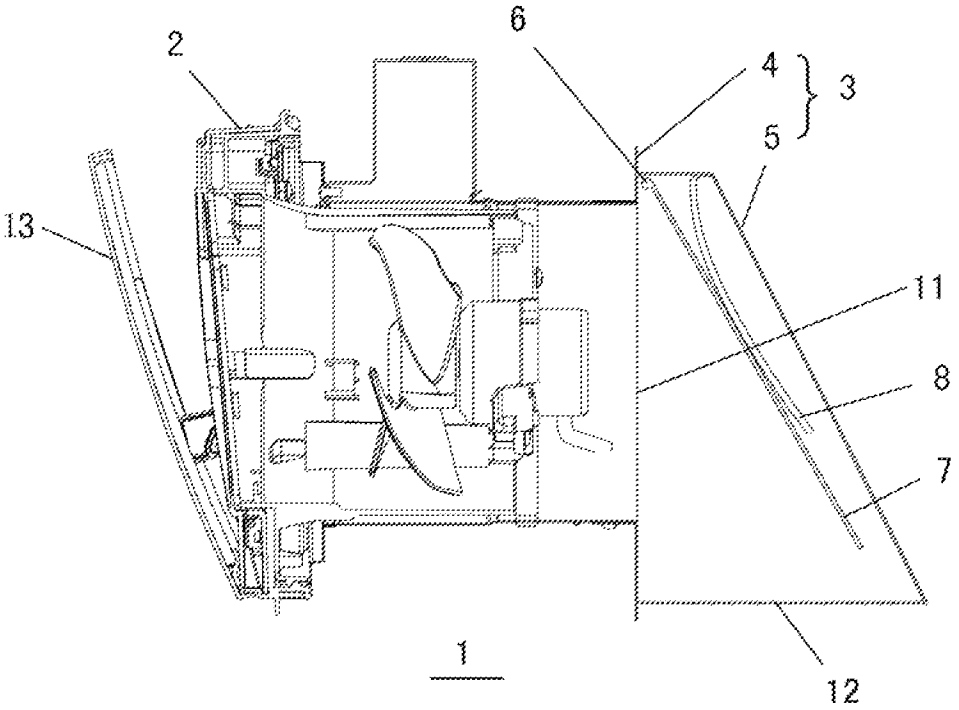
Prior Art Fig.1
FIG. 1 is a schematic view of a pipe shield of a ventilating apparatus in the prior art.
Figure 2:
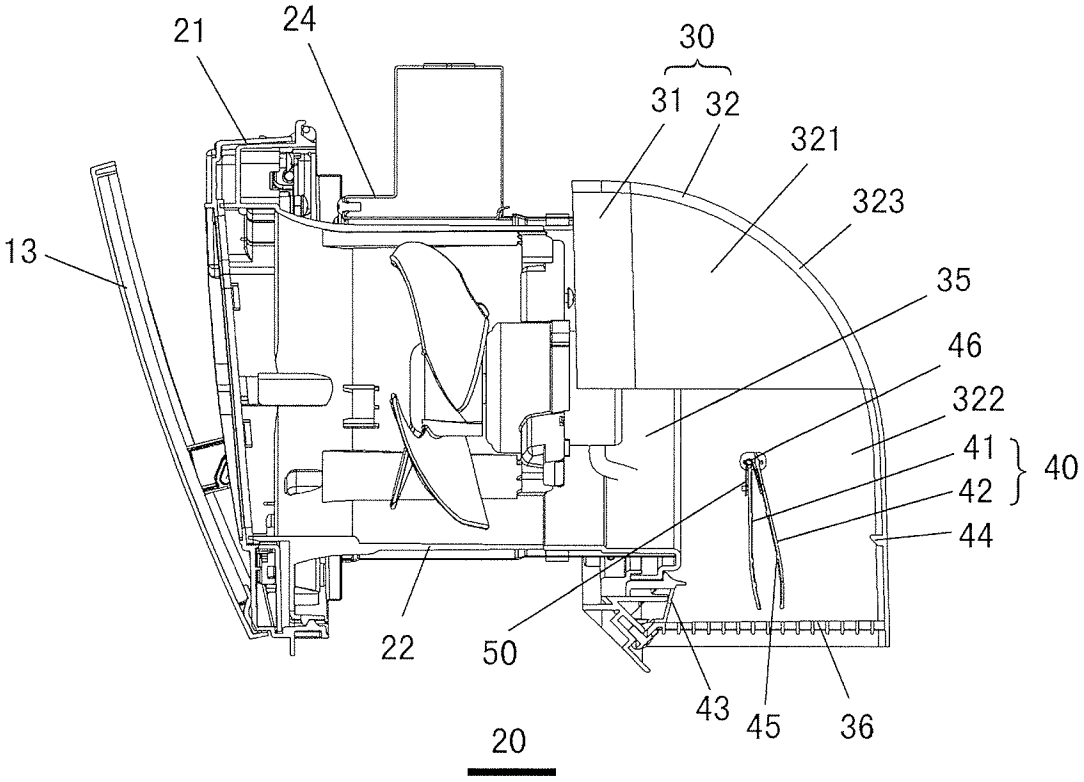
FIG. 2 is a first schematic view of a pipe shield of a ventilating apparatus according to a first embodiment of the present disclosure.
Figure 3:
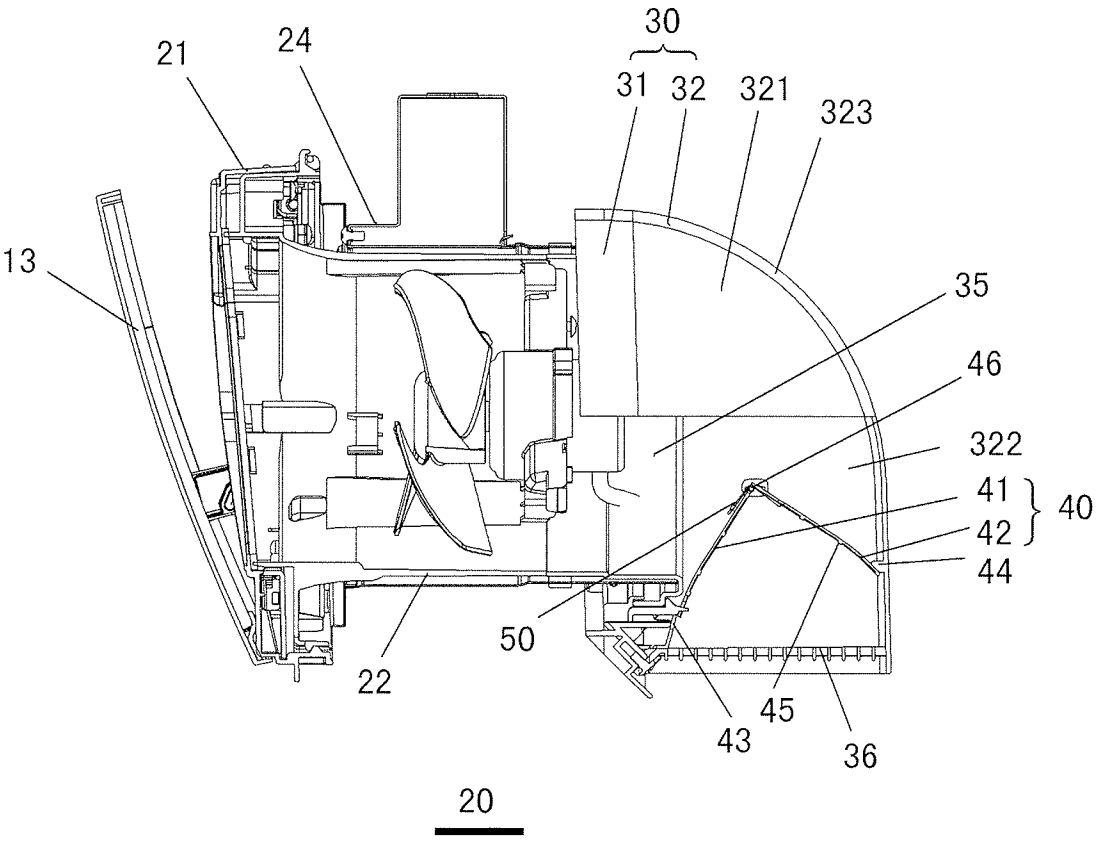
FIG. 3 is a second schematic view of the pipe shield of the ventilating apparatus according to the first embodiment of the present disclosure.

FIG. 2 is a first schematic view of a pipe shield of a ventilating apparatus according to a first embodiment of the present disclosure, wherein the ventilating apparatus is in operation; and FIG. 3 is a second schematic view of the pipe shield of the ventilating apparatus according to the first embodiment of the present disclosure, wherein the ventilating apparatus is stopped.

As shown in FIGS. 2 and 3, in the first embodiment, a pipe shield 30 for a ventilating apparatus 20 is disposed at an outdoor side relative to a ventilating apparatus body 24 disposed at an indoor side, and comprises a pipe shield base 31 and a rear cover 32. The pipe shield 30 is provided with an air inlet 35 and an air outlet 36 disposed perpendicular to each other. The rear cover 32 of the pipe shield 30 is provided with a left side plate 321, a right side plate 322 and a rear side plate 323, and the distance from the pipe shield base 31 to the rear side plate 323 of the rear cover 32 opposite to the air inlet 35 of the pipe shield 30 increases in a direction towards the air outlet 36 of the pipe shield 30.

A baffle 40 is disposed at the middle portion of the rear cover 32, and fixed within the pipe shield 30 by a rotating shaft 46 fixed on the left side plate 321 and the right side plate 322. The rotating shaft 46 is provided with a spring 50 capable of enabling the baffle 40 to unfold.

When the ventilating apparatus body 24 is stopped, the baffle 40 is adapted to close an air flow path by means of an elastic force of the spring 50. When the ventilating apparatus body 24 is in operation and the baffle 40 is adapted to open the air flow path, the baffle 40 is disposed at an intersecting surface within the pipe shield 30 and between an airflow the flow direction of which has been changed by the rear cover 32 of the pipe shield 30 and an airflow the flow direction of which has not been changed, and is disposed in the same direction as a flow direction of the air outlet 36 of the pipe shield 30.

The ventilating apparatus body 24 disposed at an indoor side has a ventilating apparatus frame 21 and a barrel 22. The ventilating apparatus frame 21 is provided with a panel 13 which is freely attachable to the ventilating apparatus body 24. The barrel 22 is provided with a ventilating apparatus motor therein.

The outdoor side of the barrel 22 is connected to the air inlet 35 of the pipe shield 30. Moreover, the air inlet 35 and the air outlet 36 of the pipe shield 30 are disposed perpendicular to each other, and the flow direction of the airflow blown out from the barrel 22 is thus perpendicular to the flow direction of the airflow blown out from the air outlet 36 of the pipe shield 30. That's to say, the flow direction of the air sucked at the panel 13 of the ventilating apparatus 20 needs to be changed at an outdoor side of the barrel 22, i.e. between the air inlet 35 of the pipe shield 30 and the air outlet 36 of the pipe shield 30.

Since the distance from the pipe shield base 31 to the rear side plate 323 of the rear cover 32 opposite to the air inlet 35 of the pipe shield 30 increases in a direction towards the air outlet 36 of the pipe shield 30, the airflow, which is farther away from the air outlet 36 of the pipe shield 30 and thus impacts on the rear side plate 323 of the rear cover 32 of the pipe shield 30 much earlier, is defined as an upper airflow in the present disclosure. The airflow, which is much closer to the air outlet 36 of the pipe shield 30 and thus impacts on the rear cover 32 of the pipe shield 30 much later, is defined as a lower airflow in the present disclosure. When the upper airflow blown out from the air inlet 35 of the pipe shield 30 impacts on the rear cover 32 of the pipe shield 30 opposite to the air inlet 35 of the pipe shield 30, the flow direction of the airflow is changed toward the air outlet 36 of the pipe shield 30 due to the resilience force of the rear cover 32 of the pipe shield 30. Moreover, since the lower airflow blown out from the air inlet 35 of the pipe shield 30 impacts on the rear cover 32 of the pipe shield 30 relatively later, the lower airflow has already be intersected and collided with the upper airflow the flow direction of which has already been changed, before the lower airflow impacts on the rear cover 32 of the pipe shield 30. However, by providing the baffle 40 at the intersecting surface between the upper airflow and the lower airflow, the flow direction of the upper airflow is changed by the rear cover 32 of the pipe shield 30, and the flow direction of the lower airflow is changed by the baffle 40, the upper airflow and the lower airflow thus may both blow out from the air outlet 36 of the pipe shield 30 without colliding and intersecting with each other, thereby preventing the upper airflow and the lower airflow from intersecting and colliding with each other and thus the resultant occurrence of the noise and the wind energy loss.

Preferably, the baffle 40 is disposed within the pipe shield 30 and at a position in a range of 25% to 65% of the distance from the pipe shield base 31 to the rear cover 32 of the pipe shield 30 opposite to the air inlet 35 of the pipe shield 30.

Since the intersecting surface between the upper airflow and the lower airflow mainly concentrates in a range of 25% to 65% of the distance from the pipe shield base 31 to the rear cover 32 of the pipe shield 30 opposite to the air inlet 35 of the pipe shield 30, the baffle 40 is provided in this range, and it can more effectively facilitate the blow-out of the upper airflow and the lower airflow from the air outlet 36 of the pipe shield 30 without the intersection and collision between the upper airflow and the lower airflow, thereby further preventing the upper airflow and the lower airflow from intersecting and colliding with each other and thus the resultant occurrence of the noise and the wind energy loss.

Moreover, since the baffle 40 is disposed at the middle portion of the rear cover 32 of the pipe shield 30 by a rotating shaft 46 and the baffle 40 is disposed in the same direction as a flow direction of the airflow blown out from the air outlet of the pipe shield when the baffle 40 is adapted to open the air flow path, only the elastic force of the spring 50 for closing the baffle 40 may need to be overcome by the air pressure so as to unfold the baffle 40. As compared to the prior art, the present disclosure may render a relatively small air resistance and has a relatively slight effect on the blast volume.

Moreover, since the baffle 40 is disposed in the same direction as the airflow blown out from the air outlet 36 of the pipe shield 30 when the ventilating apparatus body 24 is in operation and the baffle 40 is adapted to open the air flow path, in this way, when the ventilating apparatus body 24 is stopped and the baffle 40 is adapted to close the air flow path by means of the elastic force of the spring 50, the baffle 40 intersects with the air flow direction of the air outlet 36 of the pipe shield 30. When the ventilating apparatus 20 is stopped and there is an outdoor strong wind and rain, the wind and rain may enters from the air outlet 36 of the pipe shield 30 and blows towards the baffle 40, and since the force applied on the baffle 40 by the wind is in the same direction as that of the force applied by the spring 50, the baffle 40 is brought into closer and tighter contact with the pipe shield 30, thereby preventing the wind and rain from reversely flowing into the room.

Furthermore, since the baffle 40 is disposed in the same direction as the airflow blown out from the air outlet 36 of the pipe shield 30 when the ventilating apparatus body 24 is in operation and the baffle 40 is adapted to open the air flow path, the airflow blown out from the air outlet 36 of the pipe shield 30 is rectified by the baffle 40, thereby reducing noise produced due to turbulent flow.

The baffle 40 comprises a first baffle piece 41 and a second baffle piece 42. A third baffle piece 43 is provided on a wall of the pipe shield 30 in contact with an end of the first baffle piece 41, and a fourth baffle piece 44 is provided on a wall of the pipe shield 30 in contact with an end of the second baffle piece 42.

When the ventilating apparatus 20 is in operation, the baffle 40 is folded by the air pressure overcoming the elastic force of the spring 50, and the indoor air is sucked firstly at the panel 13 of the ventilating apparatus 20, then passed through the barrel 22 of the ventilating apparatus body 24 to flow to the pipe shield 30 of the ventilating apparatus 20, and finally discharged out from the air outlet 36 of the pipe shield 30. When the ventilating apparatus 20 is stopped, the baffle 40 is unfolded by the elastic fore of the spring 50. Since the baffle 40 is disposed in the same direction as the airflow blown out from the air outlet 36 of the pipe shield 30 when the baffle 40 is adapted to open the air flow path, in this way, when the baffle 40 is adapted to close the air flow path, the baffle 40 intersects with the air flow direction of the air outlet 36 of the pipe shield 30. When the ventilating apparatus 20 is stopped and there is an outdoor strong wind and rain, the wind and rain may enters from the air outlet 36 of the pipe shield 30 and blows towards the baffle 40. Further, since the baffle 40 comprises the first baffle piece 41 and the second baffle piece 42 and is adapted to close the air flow path by means of the elastic force of the spring 50, the direction of the wind blown towards the baffle 40 is in the same direction as that of the force applied by the spring 50, the ends of first baffle piece 41 and the second baffle piece 42 are both brought into closer and tighter contact with the respective walls of the pipe shield 30, thereby preventing the wind and rain from reversely flowing into the room.

Further, when the ventilating apparatus 20 is stopped and the baffle 40 is adapted to close the air flow path by means of the elastic force of the spring 50, since the baffle 40 comprises the first baffle piece 41 and the second baffle piece 42, by the elastic force of the spring 50, the end of the first baffle piece 41 and the end of the second baffle piece 42 come into contact with the walls of the pipe shield 30, respectively, and thus the air flow path is closed. Further, since the walls of the pipe shield 30 are provided with the third baffle piece 43 and the fourth baffle piece 44, respectively, when the end of the first baffle piece 41 and the end of the second baffle piece 42 come into contact with the third baffle piece 43 and the fourth baffle piece 44, respectively, the air tightness may be improved, thereby preventing the rain and wind from reversely flowing into the room through the gap between the end of the first baffle piece 41 and the third baffle piece 43 and the gap between the end of the second baffle piece 42 and the fourth baffle piece 44, and meanwhile preventing the foreign matters and worm and the like from entering into the room.

Furthermore, the third baffle piece 43 and the fourth baffle piece 44 both have the function of position limiting. When the ventilating apparatus 20 is stopped, the air flow path is closed by the first baffle piece 41 and the second baffle piece 42 due to the elastic force of the spring 50. Further, the wind and rain may enters through the air outlet 36 of the pipe shield 30 and blows towards the baffle 40, since the end of the first baffle piece 41 and the end of the second baffle piece 42 come into contact with the third baffle piece 43 and the fourth baffle piece 44, respectively, by the limitation of the third baffle piece 43 and the fourth baffle piece 44, the first baffle piece 41 and the second baffle piece 42 may stop rotation and bring into close contact with the third baffle piece 43 and the fourth baffle piece 44, respectively, so as to prevent the wind and rain from reversely flowing into the room from the air outlet 36 of the pipe shield 30.

The third baffle piece 43 is provided on the pipe shield base 31 and provided as a strip-shaped protrusion so as to overlap with the end of the first baffle piece 41. The fourth baffle piece 44 is provided on the rear cover 32 of the pipe shield 30 and provided as a protrusion in contact with the end of the second baffle piece 42.

When the ventilating apparatus 20 is stopped and the baffle 40 is adapted to close the air flow path by means of the elastic force of the spring 50, by the elastic force of the spring 50, the end of the first baffle piece 41 impacts on and overlaps with the strip-shaped protrusion provided on the pipe shield base 31 so as to come into closer engagement with each other, and the end of the second baffle piece 42 intersects with the rear cover 32 of the pipe shield 30 and comes into close engagement with it, and then contacts the protrusion provided on the rear cover 32 of the pipe shield 30, and the second baffle piece 42 is thus prevented from rotating by the limitation of the protrusion. When the ventilating apparatus body 24 is in operation and the air flow blown out from the barrel 22 impacts on the rear cover 32 of the pipe shield 30, since the fourth baffle piece 44 is provided as a protrusion on the rear cover 32 of the pipe shield 30 and has a relatively small area, it may not render the occurrence of the noise and the influence to the blast volume due to the contact with the fourth baffle piece 44.

When the baffle 40 is adapted to close the air flow path, the surfaces of the baffle 40 at an outdoor side are provided with ribs 45. When the ventilating apparatus 20 is stopped, the baffle 40 is adapted to close the air flow path by means of the elastic force of the spring 50. By providing ribs 45 on the surfaces of the baffle 40 at the outdoor side, the strength of the baffle 40 is improved. Since ribs 45 are provided at an outdoor side of the baffle 40 when the baffle 40 is adapted to close the air flow path, the baffle 40 provided within in the pipe shield 30 is adapted to open the air flow path by means of the air pressure when the ventilating apparatus 20 is in operation, the surfaces of the baffle 40 provided with ribs 45, that is the first baffle piece 41 and the second baffle piece 42, gradually become opposite to each other, as the baffle 40 opens the air flow path, and the air flown out from the air inlet 35 of the pipe shield 30 comes into contact with the surfaces 61 of the baffle 40 without the ribs 45. Furthermore, by providing ribs 45 on the surfaces of the baffle 40 at an outdoor side, the strength of the baffle 40 may be improved without the interference to the airflow blown out from the air inlet 35 of the pipe shield 30.

Figure 4:
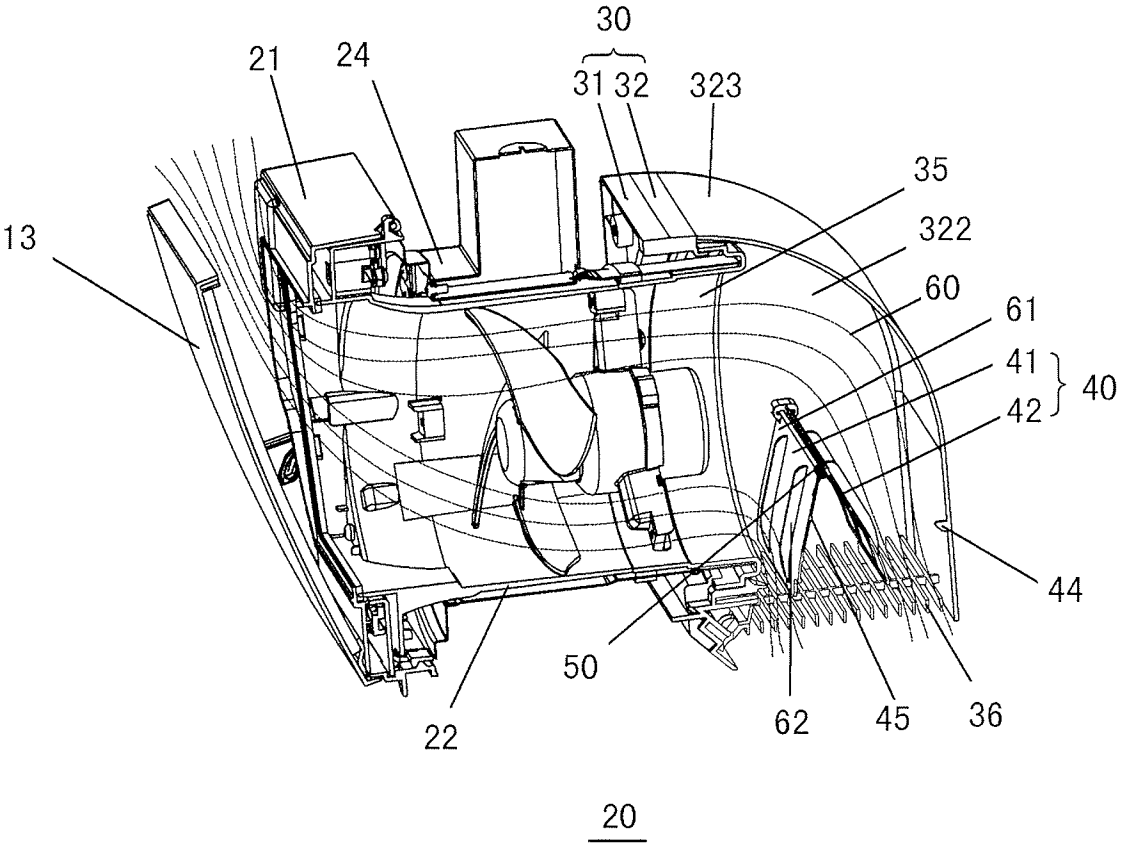
FIG. 4 is a schematic view of a pipe shield of a ventilating apparatus provided with a rib according to a second embodiment of the present disclosure.

FIG. 4 is a schematic view of a pipe shield of a ventilating apparatus provided with a rib according to a second embodiment of the present disclosure. As shown in FIG. 4, in the second embodiment, the ribs 62 are added on the basis of the first embodiment. The ribs 62 are provided on the surfaces 61, which is in contact with the airflow 60, of the baffle 40 comprising the first baffle piece 41 and the second baffle piece 42, in a direction from the air inlet 35 to the air outlet 36.

By providing ribs 62, the airflow 60 comes into contact with the ribs 62, and flows along the ribs 62 smoothly towards the air outlet 36, thereby further increasing blast volume. Even if the airflow 60 applies force on the baffle 40, the force is absorbed by the ribs 62, thereby further improving the strength of the baffle 40.

Figure 5:
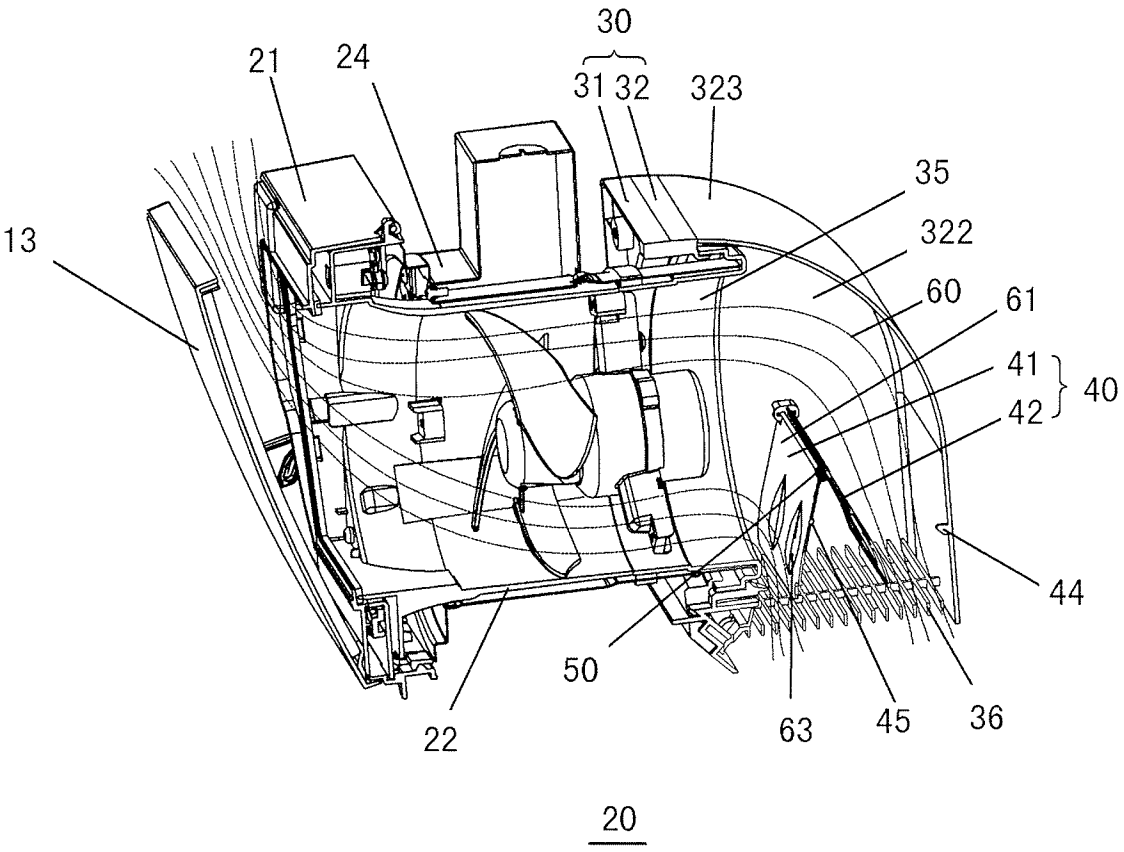
FIG. 5 is a schematic view of a pipe shield of a ventilating apparatus provided with a groove according to a third embodiment of the present disclosure.

FIG. 5 is a schematic view of a pipe shield of a ventilating apparatus provided with a groove according to a third embodiment of the present disclosure.

As shown in FIG. 5, in the third embodiment, the grooves 63 are added on the basis of the first embodiment. The grooves 63 without penetrating the surface 61 are provided on the surfaces 61, which is in contact with the airflow 60, of the baffle 40 comprising the first baffle piece 41 and the second baffle piece 42, in a direction from the air inlet 35 to the air outlet 36.

By providing the grooves 63, the airflow 60 enters into and comes into contact with the grooves 63, and flows along the grooves 63 smoothly towards the air outlet 36, thereby further increasing blast volume. The material for manufacturing the baffle 40 is reduced at the grooves 63, thereby reducing the material cost at this portion.

What is claimed is:

1. A pipe shield of a ventilating apparatus disposed at an outdoor side relative to a ventilating apparatus body disposed at an indoor side, and comprising a pipe shield base and a rear cover, wherein the pipe shield is provided with an air inlet and an air outlet disposed perpendicular to each other, and the rear cover of the pipe shield is provided with a left side plate, a right side plate and a rear side plate, wherein the left side plate is parallel to the right side plate, and the rear side plate is provided between the left side plate and the right side plate and extends from the air inlet to the air outlet such that the rear side plate is arc-shaped;

a baffle is fixed within the pipe shield by a rotating shaft and comprises a first baffle piece and a second baffle piece, wherein the rotating shaft is provided with a spring capable of enabling the baffle to unfold, and wherein the rotating shaft is fixed on the left side plate and the right side plate at a position between a middle portion of the pipe shield base and a bottom portion of the pipe shield base in a vertical direction, and in a range of 25% to 65% of a width of the air outlet from the air inlet in a horizontal direction;

the baffle is moveable between a closed position in which the ventilating apparatus body is stopped, the baffle is adapted to be unfolded through an elastic force of the spring so as to close an air flow path, and an open position; and the ventilating apparatus body is in operation and the baffle is adapted to be folded by air flow so as to open the air flow path and the first baffle piece and the second baffle piece are disposed in the same direction as a flow direction of the airflow blown out from the air outlet of the pipe shield.

2. The pipe shield of the ventilating apparatus according to claim 1, wherein a third baffle piece is provided on a wall of the pipe shield in contact with an end of the first baffle piece, and a fourth baffle piece is provided on a wall of the pipe shield in contact with an end of the second baffle piece.

3. The pipe shield of the ventilating apparatus according to claim 2, wherein the third baffle piece is provided on the pipe shield base and provided as a strip-shaped protrusion so as to overlap with the end of the first baffle piece, and the fourth baffle piece is provided on the rear cover of the pipe shield and provided as a protrusion in contact with the end of the second baffle piece.

4. The pipe shield of the ventilating apparatus according to claim 1, wherein the baffle is provided with ribs on a surface facing the air outlet when the baffle is adapted to close the air flow path.

5. The pipe shield of the ventilating apparatus according to claim 1, wherein a rib is provided on a surface of the baffle that is in contact with the airflow, in a direction from the air inlet to the air outlet.

6. The pipe shield of the ventilating apparatus according to claim 1, wherein a groove is provided on a surface of the baffle that is in contact with the airflow, in a direction from the air inlet to the air outlet.

* * * * *